US005208930A

United States Patent [19]

Chabard

[11] Patent Number: 5,208,930

[45] Date of Patent: May 11, 1993

[54] METHOD AND DEVICE FOR SUPPLYING TREATMENT PRODUCTS TO A COMPARTMENT, PARTICULARLY A WASHING MACHINE COMPARTMENT

[76] Inventor: Paul L. Chabard, 4, rue de Beaumont, CH-1206 Geneva, Switzerland

[21] Appl. No.: 777,302

[22] PCT Filed: Apr. 3, 1991

[86] PCT No.: PCT/FR91/00270

§ 371 Date: Dec. 3, 1991

§ 102(e) Date: Dec. 3, 1991

[87] PCT Pub. No.: WO91/15623

PCT Pub. Date: Oct. 17, 1991

[30] Foreign Application Priority Data

Apr. 3, 1990 [FR] France ..... 90 04267

[51] Int. Cl.[5] ..... D06F 39/02

[52] U.S. Cl. ..... 8/158; 68/12.18; 68/17 R; 222/1; 222/14; 222/651

[58] Field of Search ..... 8/158; 68/12.18, 17 R; 222/1, 14, 16, 651; 184/99.2

[56] References Cited

U.S. PATENT DOCUMENTS

| | | | |
|---|---|---|---|
| 3,771,333 | 11/1973 | Jurjans | 68/12.18 |
| 3,804,297 | 4/1974 | Jurjans | 68/12.18 X |
| 3,887,110 | 6/1975 | Porter | 222/16 |
| 4,090,475 | 5/1978 | Kwan . | |
| 4,105,138 | 8/1978 | Lehmann et al. | 222/14 |
| 4,293,211 | 10/1981 | Kaufmann | 222/651 X |
| 4,932,227 | 6/1990 | Hogrefe | 68/12.18 X |
| 4,981,024 | 1/1991 | Beldham | 68/12.18 |
| 5,014,211 | 5/1991 | Turner et al. | 68/17 R X |
| 5,118,008 | 6/1992 | Williams | 222/14 X |

*Primary Examiner*—Philip R. Coe

*Attorney, Agent, or Firm*—Armstrong, Westerman, Hattori, McLeland & Naughton

[57] ABSTRACT

A method and a device for supplying doses of various treatment products to at least one compartment of a processing machine, in particular a compartment (2) of a washing machine (1) using doses of various liquid textile treating products (8). Each product is supplied by means of a separate transfer device (17), and the machine goes through an operating procedure which involves generating a single control signal at predetermined times in the course of the treatment, combining the series of identical control signals with a selective transfer device (17) control program, and selectively controlling, according to the program, the transfer device as the control signals appear during the machine's operating procedure.

10 Claims, 1 Drawing Sheet

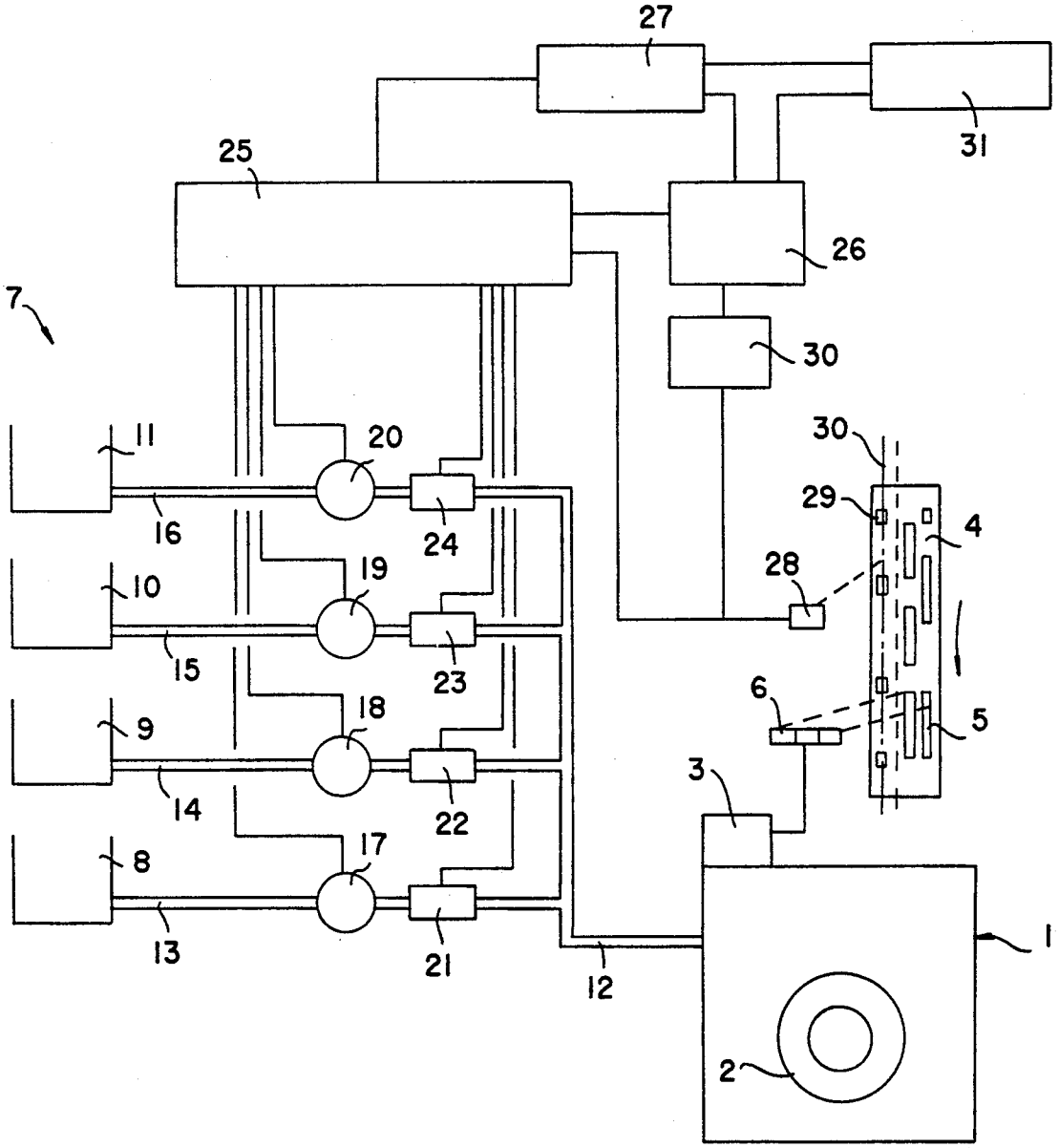
27
31
25
26
7
30
11
20
30
29
4
16
24
28
10
19
15
23
6
5
9
18
3
14
22
8
17
1
13
21
12
2

METHOD AND DEVICE FOR SUPPLYING TREATMENT PRODUCTS TO A COMPARTMENT, PARTICULARLY A WASHING MACHINE COMPARTMENT

The present invention relates to a method and a device for supplying doses of various treatment products to at least one compartment of a treatment machine, particularly a compartment of a machine for washing linen with doses of various liquid products for treatment of the latter.

During the treatment of the linen in a washing machine with a single compartment or in a washing machine of the tunnel type having several compartments, which generally includes, in particular, a first period of pre-washing, a second period of washing, a third period of rinsing, there are introduced into the compartment or compartments of the machine, at predetermined moments during its operating process, doses of various treatment products.

In order to manage the operating process, industrial washing machines are fitted with control components which generally comprise a driven tape provided with perforations associated with means for detection of these perforations. Each line of perforations is associated with a particular component of the washing machine to be controlled, for example the motor for driving of the drum, the valves for supplying with water or for draining. When it is desired to change the linen treatment cycle, a tape is used which is provided with perforations having a different configuration.

At present, in order to supply the washing machine with various treatment products, the abovementioned tape is provided with several further lines of perforations which are respectively associated with the treatment products and which serve to control the introduction of the various treatment products at predetermined moments of the treatment process. Moreover, the length of each of the perforations determines the duration of operation of the means which permit the introduction of each of the treatment products into the washing machine.

Such arrangements are however particularly restrictive and lack flexibility. In fact, for each treatment process, the number of punched tapes has to be multiplied so that one particular program for supplying with treatment products is associated with each tape.

A particular object of the present invention is to remedy these disadvantages.

The method according to one subject of the invention permits the supplying of doses of various treatment products to at least one compartment of a treatment machine, particularly a compartment of a machine for washing linen with doses of various liquid products for treatment of the linen, each product being supplied with the help of a separate transfer means and the machine being subject to an operating process.

The method according to the invention consists in generating, at predetermined moments during the operating process of the machine, a control signal which is identical each time; in associating with the sequence of identical control signals a program for selective control of said transfer means and of volumetric quantities of the corresponding products; and in controlling selectively, in accordance with said program, the transfer means as and when the control signals appear during the operating process of the machine, this control consisting, for each product to be supplied, in starting its transfer means at the appearance of the associated signal, in measuring the volume of this product supplied to the compartment and in stopping this transfer means when the volume of this product supplied to the compartment corresponds to the volumetric quantity predetermined in accordance with said program.

According to the invention, it is particularly advantageous to associate with the sequence of the identical control signals a plurality of programs for selective control of the transfer means, to select one of these programs, and to control selectively, in accordance with the program chosen, the transfer means as and when the control signals appear during the treatment process.

The method according to the invention preferably consists in counting the control signals and in memorizing the number of control signals which have appeared since the start of the operating process of the machine.

The method according to the invention may advantageously consist in controlling each of the transfer means so that they supply predetermined volumetric quantities of product.

The present invention also relates to a supply device particularly adapted for the implementation of the abovementioned method. According to the invention this device comprises means for generating a control signal at predetermined moments during the operating process of the machine, means for memorizing a program for selective control of the transfer means and volumetric quantities of the corresponding products, control means connected to said means generating successively a control signal and to said memorizing means and controlling selectively the starting and the stopping of said transfer means in accordance with the program memorized, each transfer means comprising a checking means for measuring of the volumetric quantity of product supplied, which is connected to said control means, and also means for this quantity to the volumetric quantity memorized.

According to the invention, said checking means may be constituted by a flow meter.

According to the invention, said memorizing means are preferably adapted to memorize a plurality of control programs. The device further comprising selection means for selecting for one of these programs.

The device according to the invention preferably comprises means for means of counting and memorizing the number of control signals generated since the start of the operating process of the machine, these means being connected to the program memorizing means and to the control means which were mentioned above.

According to the invention, each transfer means preferably comprises a flow meter so as to measure the volume of product introduced into the machine.

The device according to the invention may further comprise programming means making it possible to set up the programs for selective control of the transfer means and/or to fix the volumetric quantities of product to be supplied.

According to the invention, the means for control of the operating process of the machine may advantageously comprise a punched tape, said means for generating a control signal comprising means for detection of perforations made in said tape and arranged in a manner aligned in the direction in which this tape runs past.

In another version, the means for control of the operating process of the machine comprise a programmed automaton.

The present invention will be better understood by the study of a machine for washing linen fitted with a device for supplying to its compartment various liquid products for treatment of the linen, described as a non-limiting example and shown diagrammatically in the single attached FIGURE.

In the example shown, the washing machine 1 comprises a washing compartment 2 in which is provided a drum not visible in the FIGURE.

This machine 1 is subject to a control component 3 which manages its operating process and which controls for example the motor for driving of the drum, optionally at different speeds, the water supply components, the water discharge components, the treatment temperatures.

In order to generate the operating process of the machine 1, the component 3 is fitted with a tape 4 which has various lines of perforations 5 associated respectively with the components of the machine 1 to be controlled. The punched tape 4 is driven by a drive component (not shown) which enables it to be caused to run past at constant speed in front of components 6 for detection of the various lines of perforations 5. These detection means 6 are optical or mechanical. In general, they control the components of the machine when they detect the perforations, the length of the latter determining the duration of operation of the components of the machine.

The washing machine 1 is fitted with a device for the supply of various liquid products for treatment of the linen, generally indicated by the reference 7.

In the example shown, the device 7 comprises four reservoirs 8 to 11 which each contain a different liquid treatment product. The reservoirs 8 to 11 are connected to a pipe 12 connected to the compartment of the washing machine 1 via parallel pipes 13 to 16 on which are respectively provided transfer pumps 17 to 20 and flow meters 21 to 24.

The supply device 7 further comprises an electronic control circuit 25 which controls the pumps 17 to 20 and which receives the flow information supplied by the flow meters 21 to 24.

The supply device 7 also comprises an electronic circuit for memorizing of control programs which is connected to the control circuit 25, and a program selector 27 which is connected to the electronic control circuit 25 and to the electronic memorizing circuit 26.

The supply device 7 further comprises a detector 28 which serves to detect successively, during the running past of the punched tape 4, perforations 29 made on a line 30 of this tape 4 at predetermined places relative to the various perforations 5 controlling the operating process of the washing machine 1. The detector 28 supplies, at each detection of a perforation 29, a control signal, identical every time, to the electronic control circuit 25. The perforations 29 therefore constitute a program of control signals created in accordance with the operating process of the washing machine 1.

Each control program contained in the memorizing circuit 26 is so designed that it makes it possible to associate with the sequence of identical control signals supplied by the detector 28 at the passing of the sequence of perforations 29 when the tape 4 runs past a separate program for selective control of the pumps 17 to 20 and of the given quantities of the products to be supplied to the machine.

Thus, at each control signal supplied by the detector 28 at the time of the detection of the perforations 29, each control program contained in the program memorizing circuit 26 may provide for the absence of control of the pumps 17 to 20, the control of one of the pumps so as to supply a given quantity of the liquid contained in the reservoir associated with that pump or the control of several of the pumps for the supply of a given quantity of the liquid contained in the reservoirs which are respectively associated with them. To this end, a comparator is built into the electronic control circuit 25, this comparator being adapted to compare the volumetric quantity of product supplied and the volumetric quantity memorized in the circuit 26, and this for each product.

Of course, the electronic control circuit 25 starts the pump or pumps to be controlled and stops their operation when the flow meter which is associated with them indicates that the programmed volume of liquid has been supplied to the washing machine 1.

In order to give a clear understanding of the operation of the supply device 7, some examples will now be described.

EXAMPLE 1

The tape 4 has perforations 5 corresponding to an operating process of the washing machine 1 or treatment cycle of the linen contained in its compartment 2 which comprises successively a washing period, a rinsing period and a spin drying period. There is provided on the tape 4 two aligned perforations 29, the one in the middle of the washing period and the other at the start of the rinsing period.

It is desired only to introduce a quantity V1 of a washing product contained in the reservoir 8 at the start of the washing period.

The memorizing circuit 26 contains a program P1 designed so that upon reception of the first control signal supplied by the detector 26 at the passing of the first perforation 29, the control circuit 25 starts the pump 17 and stops the latter when the flow meter 21 indicates that the volume V1 of the product has been supplied to the machine, and so that upon reception of the second control signal supplied by the detector 28 at the time of passing of the second perforation 29, the control circuit 25 is not controlling any of the pumps 17 to 20.

The operator having fitted the punched tape 4 onto the control component 3 of the washing machine 1, and selected the program P1 on the program selector 27, he starts the washing machine 1. As the tape 4 runs past, the operating process of the latter is controlled by the perforations 5 and the process of supplying with treatment product is controlled by the perforations 29 in accordance with the selected program P1 described above.

EXAMPLE 2

In addition to the introduction of the volume V1 of the product contained in the reservoir 8 at the start of the washing process, a volume V2 of the product contained in the reservoir 9 is desired to be introduced in the middle of the rinsing process.

The operator then selects another program P2 such that, at the first signal supplied by the detector 28 at the passing of the first perforation 29, the control circuit 25 controls the pump 17 and stops this pump when the flow meter 21 signals that the volume V1 has been supplied, and that at the second signal supplied by the detector 28 at the passing of the second perforation 29, the control circuit 25 starts the pump 18 and stops the latter when the volume V2 of the treatment liquid contained in the reservoir 9 has been supplied.

EXAMPLE 3

Linen contained in the compartment 2 of the machine 1 is desired to be washed according to a treatment process which comprises in particular, successively, a pre-washing period, a washing period and a rinsing period. A punched tape 4 having perforations 5 controlling such a process is then arranged on the control component 3 of the machine 1.

This tape is also provided with a sequence of perforations 29 which are arranged in correspondence with the perforations 5, at the start of the pre-washing process, at the start of the washing process and at the start of the rinsing process.

At the start of the pre-washing process, it is desired to introduce volumes V3 and V4 of the products contained in the reservoirs 10 and 11 into the machine 1, and, at the start of the washing process, it is desired to introduce a volume V1 of the product contained in the reservoir 8 into the machine 1.

.The memorizing circuit 26 contains a program P3, which the operator selects by the selector 27, such that, upon reception of the first control signal supplied by the detector 28, at the passing of the first perforation 29, the control circuit 25 starts the pumps 19 and 20 and stops the latter respectively when the flow meters 23 and 24 signal that the volumes V3 and V4 have been supplied, such that, upon reception of the second signal supplied by the detector 28 at the passing of the second perforation 29, the control circuit 25 starts the pump 17 and stops this pump when the flow meter 21 indicates that the volume V1 of product 8 has been introduced, and such that, when the detector 28 supplies a control signal at the passing of the third perforation 29, the control circuit 25 is not controlling any of the pumps 17 to 20.

EXAMPLE 4

The programming circuit 26 comprises a control program P4 which repeats the control program P, and which further serves to introduce a volume V2 of the product contained in the reservoir 9 when the third perforation 29 of the tape 4' passes in front of the detector 28.

As may be seen in the FIGURE, the supply device 7 further comprises a programming circuit 31 provided with a programming keyboard and linked to the memorizing circuit 26 and to the selector 27. By means of this programming circuit 31, the operator makes up the programs for selective control of the pumps in accordance with the perforations 29 of the tapes 4 and fixes the volumetric quantities of the treatment products to be supplied to the washing machine 1. Thus, the operator can adapt to his choice the program for supply of treatment products depending on the linen which he has to treat and on the operating process of the washing machine 1. He may for example modify the quantities of treatment products to be supplied in a program for control of the pumps which has already been created.

The supply device 7 further comprises a counting and memorizing circuit 30 which serves to count the control signals which are supplied by the detector 28 since the start of the treatment process generated by the tape 4. Thus, if this treatment process is stopped, for example because of a break in the electrical supply circuit of the washing machine 1, the control device 7 can then resume the process of supplying with liquid treatment products when the machine 1 is restarted, at the place where it had been interrupted.

The present invention is not limited to the example described above. In particular, the tape 4, provided for the control of the treatment process or operating process of the washing machine 1 and for the control of the means for transfer of the products to the compartment of the latter, could be replaced by an electromechanical or electronic programmer or automaton which would be adapted to supply a sequence of identical control signals at predetermined moments during the operating process of the washing machine 1 which it would generate, this sequence further being optionally programmable.

The present invention can moreover be applied to a washing machine having several compartments, and to any other machines for treatment of products into which it is required to introduce treatment products, liquid or otherwise.

Many other variant embodiments and variant applications of the invention are possible without going beyond the scope defined by the attached claims.

What is claimed is:

1. A method for supplying at least one compartment of at least one treatment machine with doses of various treatment products, wherein the treatment machine undergoes an independent treatment operating process, said method comprising the steps of:

providing the machine with separate transfer means for respectively transferring the products to the compartment, each transfer means including a pump means and a volumetric metering means;

memorizing a program selectively associating the transfer means and volumetric quantities of the corresponding products with a sequence of control signals;

generating the sequence of control signals which are identical each time and which appear at predetermined periods during said treatment operating process;

and, along the treatment operating process, successively controlling, in accordance with said program, said transfer means as the control signals are generated, wherein the controlling of the transfer means of each product to be supplied includes the steps of starting the corresponding pump means at a detection of the associated control signal, measuring the volume of the product to be supplied with the corresponding volumetric metering means, comparing the measured volume with the memorized volumetric quantity of the product, and stopping said corresponding pump means when the measured volume is equal to the volumetric quantity of the product as predetermined by said program.

2. The method as set forth in claim 1, wherein said step of selectively controlling said transfer means includes the step of selectively controlling said transfer means with respect to aid sequence of identical control signals based on a plurality of programs, selecting one of said plurality of programs, and selectively controlling, in accordance with a chosen program, said corresponding transfer means as said control signals are generated.

3. The method as set forth in claim 1 or 2, further comprising the steps of counting said control signals and memorizing the counted number of said control signals which have appeared since a start of said treatment operating process of said treatment machine, wherein the treatment can be continued if it has been stopped.

4. A supply device for supplying at least one compartment of a treatment machine with doses of various treatment products, said machine having an independent treatment operating process, said device comprising:

separate transfer means for respectively transferring the products to the compartment, each transfer means including a pump means;

means for memorizing a program for selective control of said transfer means with regard to a sequence of control signals and for memorizing volumetric quantities of respective products;

means for generating, successively as said sequence of control signals, a control signal at predetermined periods during the treatment operating process of said treatment machine;

control means connected to said generating means and said memorizing means, said control means selectively controlling a starting and a stopping of said transfer means in accordance to said program having been memorized, each of said transfer means further including a volumetric metering means for measuring the volume of product being supplied, said volumetric metering means being connected to said control means, and said control means further including comparing means for comparing the volume supplied and the volume memorized and generating a signal for stopping said transfer means.

5. Device as claimed in claim 4, characterized by the fact that it comprises programming means (31) serving to create the programs for selective control of the transfer means and to fix the volumetric quantities of treatment products to be supplied.

6. Device as claimed in claim 4, characterized by the fact that said checking means is a flow meter.

7. Device as claimed in claim 4, characterized by the fact that the means for control of the operating process of the machine comprise a punched tape (4), said means for generating a control signal comprising means (28) for detection of perforations made in said tape and arranged in aligned manner (30) in the direction in which this tape runs past.

8. Device as claimed in claim 4, characterized by the fact that the means for control of the operating process of the machine comprise a programmed automaton.

9. The supply device as set froth in claim 4, wherein said memorizing means memorizes a plurality of control programs, said memorizing means further including selection means for selecting one of said plurality of control programs.

10. The supply device as set forth in claim 4, further comprising counting means for counting the number of generated control signals, and memorizing means for memorizing the number of control signals generated since a start of an operating process of said treatment machine, said counting means and said memorizing means being connected to said program memorizing means and to said control means.

* * * * *